US007918539B2

(12) United States Patent
Imanaka et al.

(10) Patent No.: US 7,918,539 B2
(45) Date of Patent: Apr. 5, 2011

(54) LIQUID DISCHARGE HEAD

(75) Inventors: Yoshiyuki Imanaka, Kawasaki (JP); Takuya Hatsui, Tokyo (JP); Souta Takeuchi, Yokohama (JP); Takaaki Yamaguchi, Yokohama (JP); Takahiro Matsui, Koganei (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 69 days.

(21) Appl. No.: 12/427,969

(22) Filed: Apr. 22, 2009

(65) Prior Publication Data

US 2009/0207210 A1 Aug. 20, 2009

Related U.S. Application Data

(62) Division of application No. 10/582,503, filed as application No. PCT/JP2005/020397 on Nov. 1, 2005, now Pat. No. 7,549,734.

(30) Foreign Application Priority Data

Nov. 10, 2004 (JP) ..... 2004-326781

(51) Int. Cl.
*B41J 2/05* (2006.01)
*B41J 2/15* (2006.01)
*B41J 2/145* (2006.01)

(52) U.S. Cl. ..... 347/58; 347/40

(58) Field of Classification Search ..... 347/58
See application file for complete search history.

(56) References Cited

U.S. PATENT DOCUMENTS 5,121,143 A 6/1992 Hayamizu ..... 347/63
5,731,828 A 3/1998 Ishinaga et al. ..... 347/62
5,841,448 A 11/1998 Moriyama et al.
6,042,222 A 3/2000 Moritz, III et al.
6,095,640 A 8/2000 Ishinaga et al.
6,224,195 B1 5/2001 Maru et al.
6,374,482 B1 4/2002 Mihara et al.
6,378,993 B1 4/2002 Ozaki et al.
6,382,772 B1 5/2002 Kamiyama et al.
6,394,588 B2 5/2002 Moon et al. ..... 347/65
6,439,700 B1 8/2002 Ishinaga et al.
6,443,563 B1 9/2002 Saito et al.
6,454,379 B1 9/2002 Taneya et al.
6,474,769 B1 11/2002 Imanaka et al.
6,474,790 B2 11/2002 Kaneko ..... 347/59
(Continued)

FOREIGN PATENT DOCUMENTS

CN 1210073 3/1999
(Continued)

*Primary Examiner* — Stephen D Meier
*Assistant Examiner* — Alexander C Witkowski
(74) *Attorney, Agent, or Firm* — Fitzpatrick, Cella, Harper & Scinto

(57) ABSTRACT

A recording head includes outlets disposed in a staggered pattern so that the distances from an ink inlet to the outlets differ alternately for adjacent outlets. The recording head includes an outlet group including a plurality of the outlets on at least one side of the ink inlet. The outlet group includes first outlets and second outlets, wherein the distance from the ink inlet to the first outlets differs from the distance from the ink inlet to the second outlets. First recording elements and second recording elements including heat resistors are provided. The first recording elements and second recording elements correspond to the first outlets and the second outlets, respectively, and are disposed in first ink channels and second ink channels, respectively. The first recording elements are rectangular, whereas the second recording elements are substantially square.

8 Claims, 8 Drawing Sheets

U.S. PATENT DOCUMENTS

| | | | | |
|---|---|---|---|---|
| 6,485,132 | B1 | 11/2002 | Hiroki et al. | |
| 6,491,380 | B2 | 12/2002 | Taneya et al. | |
| 6,755,509 | B2 | 6/2004 | Silverbrook et al. | 347/62 |
| 6,789,877 | B2 * | 9/2004 | Murakami et al. | 347/40 |
| 6,799,822 | B2 | 10/2004 | Cleland et al. | 347/12 |
| 7,004,569 | B2 | 2/2006 | Mochizuki et al. | 347/58 |
| 7,628,472 | B2 | 12/2009 | Tomizawa et al. | |
| 2003/0117462 | A1 | 6/2003 | Cleland et al. | |
| 2004/0179070 | A1 | 9/2004 | Hamazaki et al. | |
| 2004/0218007 | A1 | 11/2004 | Tomizawa et al. | |
| 2007/0103501 | A1 | 5/2007 | Hatsui et al. | |

FOREIGN PATENT DOCUMENTS

| | | | |
|---|---|---|---|
| CN | 1517215 | | 8/2004 |
| EP | 0 691 204 | | 1/1996 |
| EP | 1 308 284 | | 5/2003 |
| JP | 63-115758 | A | 5/1988 |
| JP | 2002-79672 | | 3/2002 |
| JP | 2002-374163 | | 12/2002 |
| JP | 2004-230885 | A | 8/2004 |
| JP | 2004-268430 | A | 9/2004 |

* cited by examiner

LIQUID DISCHARGE HEAD

LIQUID DISCHARGE HEAD

This application is a division of U.S. patent application Ser. No. 10/582,503, filed Jun. 9, 2006, which has been allowed and which is a National Phase of International Application No. PCT/JP2005/020397, filed on Nov. 1, 2005.

TECHNICAL FIELD

The present invention relates to a liquid discharge head configured to discharge liquid and, more specifically, relates to an inkjet recording head (hereinafter referred to as 'recording head') configured to use heat radiated from heating resistors to discharge ink onto a recording medium.

BACKGROUND ART

A known recording head described in Japanese Patent Laid-Open No. 2002-79672 includes two nozzle rows, each row including a plurality of nozzles aligned at a regular pitch, and an ink inlet provided between the nozzle rows. By providing nozzles on both sides of the ink inlet so that nozzles in one nozzle row are offset by a half pitch from the nozzles in the other nozzle row, the nozzle density of a known recording head having such a structure is two times the nozzle density of a recording head including only one nozzle row.

FIG. 1 is a perspective plan view illustrating the inlets and their periphery of a known recording head. As illustrated in FIG. 1, on both sides of an ink inlet 1500, a plurality of outlets 1100 are aligned at a predetermined pitch in the longitudinal direction of the ink inlet 1500(i.e., the vertical direction in the drawing). The ink inlet 1500 communicates with nozzles that each include one of the outlets 1100 and an ink channel 1300. In this way, ink is supplied from the ink inlet 1500 to each of the outlets 1100.

More specifically, the ink channel 1300 is constituted of a pressure chamber 1302 that includes a recording element 1400 having a heating resistor and a transporting path 1301 for supplying ink to the pressure chamber 1302. The pressure chamber 1302 is a space where discharge energy is applied to ink. The pressure chamber 1302 must be large enough to enable appropriate discharge of ink from the outlet 1100.

Japanese Patent Laid-Open No. 2002-374163 describes a recording head including recording elements each having a heating resistor, a driver (for example, a transistor) for driving the recording element, and a logic circuit for selectively driving the driver in accordance with image data.

A commercialized version of the recording head shown in FIG. 1 has a nozzle density of 1,200 dots per inch (dpi) per color (i.e., the nozzle density for each nozzle row is 600 dpi) and an ink droplet volume of 2 picoliters (pl) for each ink droplet discharged from the outlets 1100. However, in order to produce high quality images, a recording head capable of discharging droplets having even smaller volumes is in need. To obtain such a recording head, the nozzle density may be increased while the volume of the droplets discharged from the nozzles is decreased. More specifically, for example, the discharge amount of a recording head may be less than 2 pl and the nozzle density of two nozzle rows included in the recording head may be 2,400 dpi, wherein the nozzle density of each nozzle row is 1,200 dpi.

However, since the outlets 1100 of the recording head having the above-described nozzle density are aligned in rows along the longitudinal direction of the ink inlet 1500, it becomes difficult to maintain the thickness of the walls between each ink channel 1300. As a result, the reliability of the recording head is reduced.

To solve this problem, a recording head according to an embodiment of the present invention includes nozzle rows having outlets 1100 arranged in a staggered pattern, as illustrated in FIG. 2. The recording head shown in FIG. 2 is structured so that the distances from the ink inlet 1500 to adjacent outlets 1100 alternate. The ink channels 1300 corresponding to the outlets 1100 disposed closer to the ink inlet 1500 include transporting paths 1301 and pressure chambers 1302. Ink channels 1305 corresponding to the outlets 1100 disposed further away from the ink inlet 1500 include transporting paths 1306, wherein each of the transporting paths 1306 are interposed between adjacent pressure chambers 1302.

When the outlets 1100 are disposed in a staggered pattern with respect to the ink inlet 1500, as described above, the lengths of transporting paths 1301 and the transporting paths 1306 differ. Since the nozzle density is expected to be high (i.e., the pitch of the nozzles is expected to be small), the difference in the lengths of the transporting paths causes a significant difference in the channel resistance at the rear area of the heating resistors. Furthermore, the heating resistors disposed closer to the inlet 1500 are shaped as rectangles extending in the longitudinal direction of the channels so as to increase their heating areas. The rectangular shape of the heating resistors causes the difference in the lengths of the transporting paths to become even more prominent.

This difference in the lengths of the transporting paths causes a difference in the refilling speed. It is difficult to obtain a satisfactory refilling speed in the liquid channels corresponding to the heating resistors disposed further away from the inlet 1500.

The difference in the channel resistance also causes a difference in the discharge performance of the outlets. A significant difference in the discharge performance of each outlet may cause a decrease in image quality.

Such problems are not only typical to recording heads configured to discharge droplets of the same volume from the nozzles. For example, a recording head including both nozzles for discharging droplets of a relatively large volume and nozzles for discharging droplets of a relatively small volume may also have the same problems when the nozzle density is increased. These problems are not limited to recording heads configured to carry out recording by discharging ink. The same problems may be experienced also in liquid discharge heads used in the technical fields other than recording (e.g., color filter manufacturing and circuit pattern drawing) that discharge liquid using recording elements including heating resistors.

DISCLOSURE OF INVENTION

The present invention is configured on the basis to solve the above-described problems and provides a liquid discharge head including outlets disposed in a staggered pattern so that the distances from the outlets to an inlet differ in such a manner that the outlets disposed further away from the inlet are also capable of stably discharging liquid.

A liquid discharge head according to an embodiment of the present invention includes a plurality of outlets for discharging liquid, liquid channels that communicate with the corresponding outlets, an inlet, provided on a substrate and configured to supply liquid to the liquid channels, recording elements disposed opposite to the plurality of outlets include heating resistors provided on the substrate. The outlets include first outlets disposed relatively closer to the inlet and second outlets disposed relatively further from the inlet and are arranged in a staggered pattern in which the first outlets and the second outlets are disposed alternately on at least one side of the inlet. The recording elements include first recording elements corresponding to the first outlets and second recording elements corresponding to the second outlets. An aspect ratio based on the flow direction of the liquid channels of the first recording elements is greater than the aspect ratio of the second recording elements.

Since the second recording elements corresponding to the second outlets disposed further away from the inlet included in the liquid discharge head according to an embodiment of the present invention are substantially square, the second recording elements are capable of applying discharge energy more efficiently to the liquid compared to rectangular recording elements. As a result, the second outlets are also capable of stably discharging liquid.

Further features of the present invention will become apparent from the following description of exemplary embodiments (with reference to the attached drawings).

BRIEF DESCRIPTION OF THE DRAWINGS

FIGS. 6A, 6B and 6C illustrate details of a recording element, wherein FIG. 6A is a top view of a wiring pattern configuring the recording element and FIGS. 6B and 6C illustrate cross-sectional views taken along lines VIB-VIB and VIC-VIC, respectively, shown in FIG. 6A.

BEST MODE FOR CARRYING OUT THE INVENTION

Now, embodiments of the present invention will be described with reference to the drawings.

First Embodiment

Figure 1:
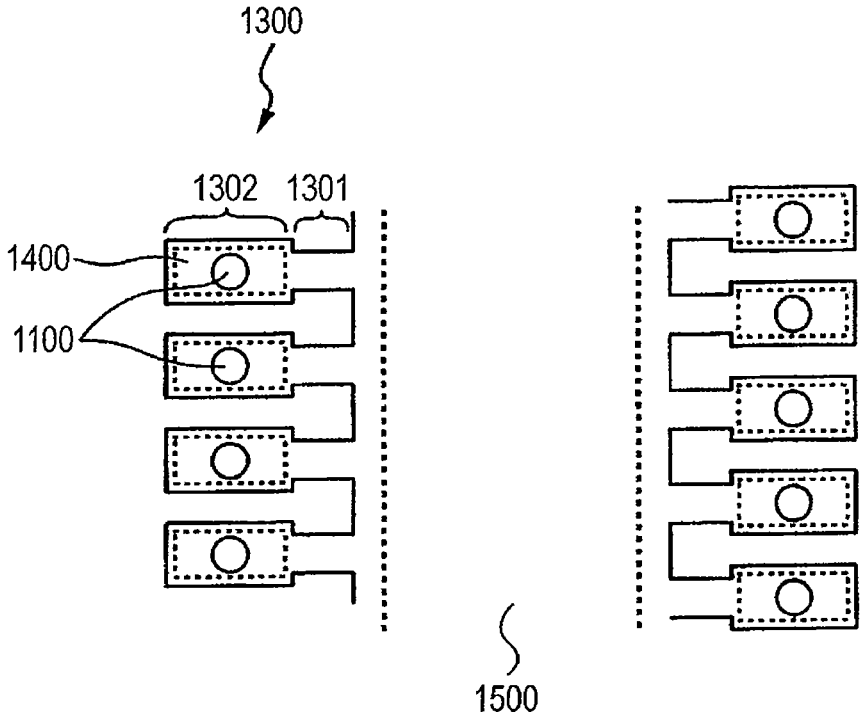
FIG. 1 is a perspective plan view of a known recording head.
Figure 2:
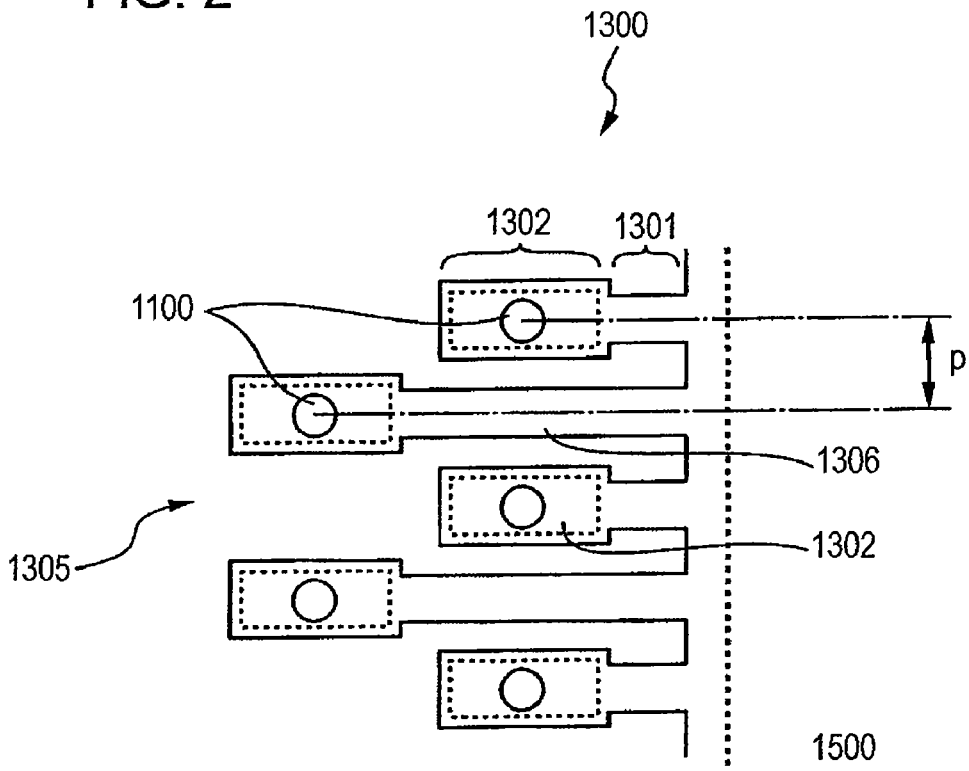
FIG. 2 is a perspective plan view of a recording head including outlets disposed in a staggered pattern.
Figure 3:
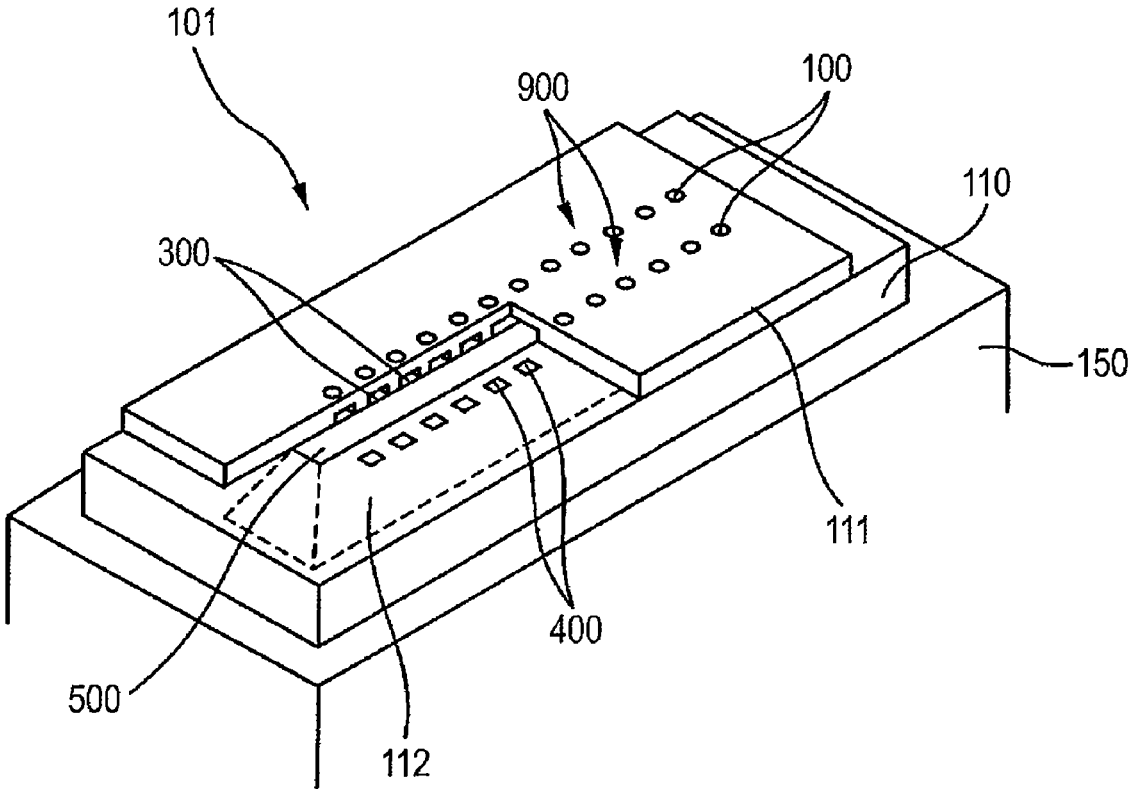
FIG. 3 is a perspective schematic view of a recording head according to a first embodiment.

FIG. 3 is a perspective schematic view of a recording head according to a first embodiment.

As shown in FIG. 3, a recording head 101 includes a silicon (Si) substrate 110 (semiconductor substrate) and a channel-forming member 111. On the upper surface of the Si substrate 110, a plurality of recording elements 400 having, for example, heating resistors is provided. The channel-forming member 111 covers the recording elements 400 on the Si substrate 110. Although the present invention is characterized by the recording elements 400 and their peripheral structure, first, the overall structure of the recording head 101 will be briefly described.

The Si substrate 110 includes a common liquid chamber 112 penetrating through the Si substrate 110. On the upper surface of the common liquid chamber 112, an opening is provided so as to function as a longitudinal ink inlet 500. Although FIG. 3 only shows the recording elements 400 on one side of the ink inlet 500, the recording elements 400 are provided along the ink inlet 500 on both sides. The recording elements 400 include heating resistors, whose detailed structure will be described below, configured to radiate heat when a voltage is applied from the outside via electrical wiring not shown in the drawing. By heating the ink, discharge energy is applied to the ink.

Figure 4:
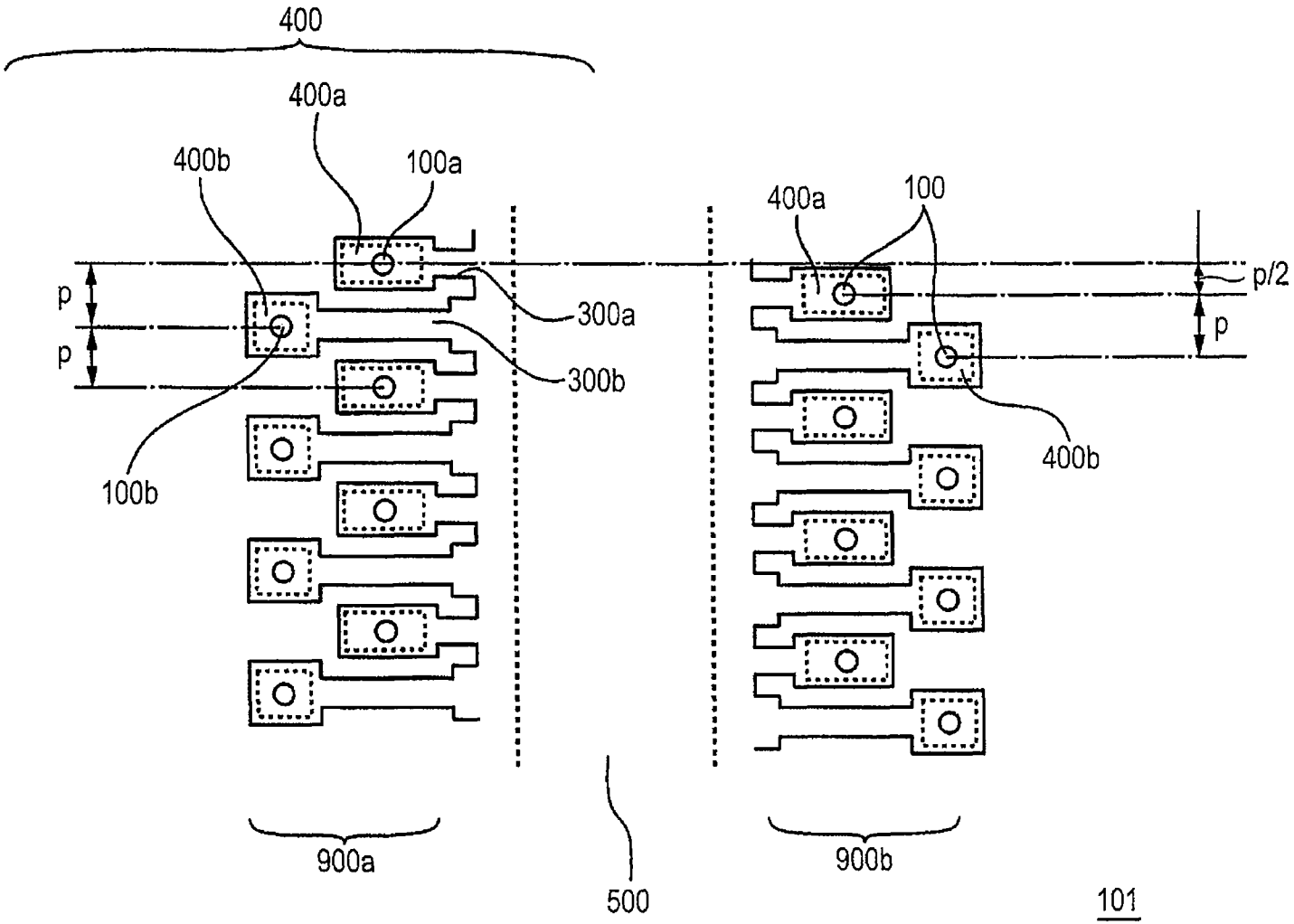
FIG. 4 is a partial perspective plan view of an outlet surface of the recording head shown in FIG. 3 and illustrates recording elements and their periphery.

In FIG. 3, the recording elements 400 are aligned along the longitudinal direction of the ink inlet 500. However, as illustrated in FIG. 4, the recording elements 400 are actually disposed in a staggered pattern, as described below.

The channel-forming member 111 includes a plurality of outlets 100 configured to discharge ink. Each of the outlets 100 is disposed opposite to each of the corresponding recording elements 400. The outlets 100 constitute of two outlet groups 900 provided on both sides of the ink inlet 500. A plurality of ink channels 300 configured to guide ink from the ink inlet 500 to the outlets 100 are interposed between the channel-forming member 111 and the upper surface of the Si substrate 110.

The recording head 101 having such a structure is aligned and fixed on an ink supplying member 150 having an ink channel (not shown) for supplying ink to the common liquid chamber 112 in the Si substrate 110. When the recording head 101 is in use, it operates as described below. First, a voltage applied to the recording elements 400 from outside via electrical wiring (not shown) causes the recording elements 400 including heating resistors to radiate heat. The thermal energy causes the ink inside the ink channels 300 to boil. The bubbles generated by this boiling pushes the ink in the ink channels 300 out from the outlets 100 as ink droplets. The recording head 101 having such a structure carries out the above-described operation while the upper surface of the channel-forming member 111, i.e., the outlet surface, opposes a recording medium, such as paper. As a result, the discharged ink droplets are applied to the recording medium to form an image on the recording medium.

Figure 5:
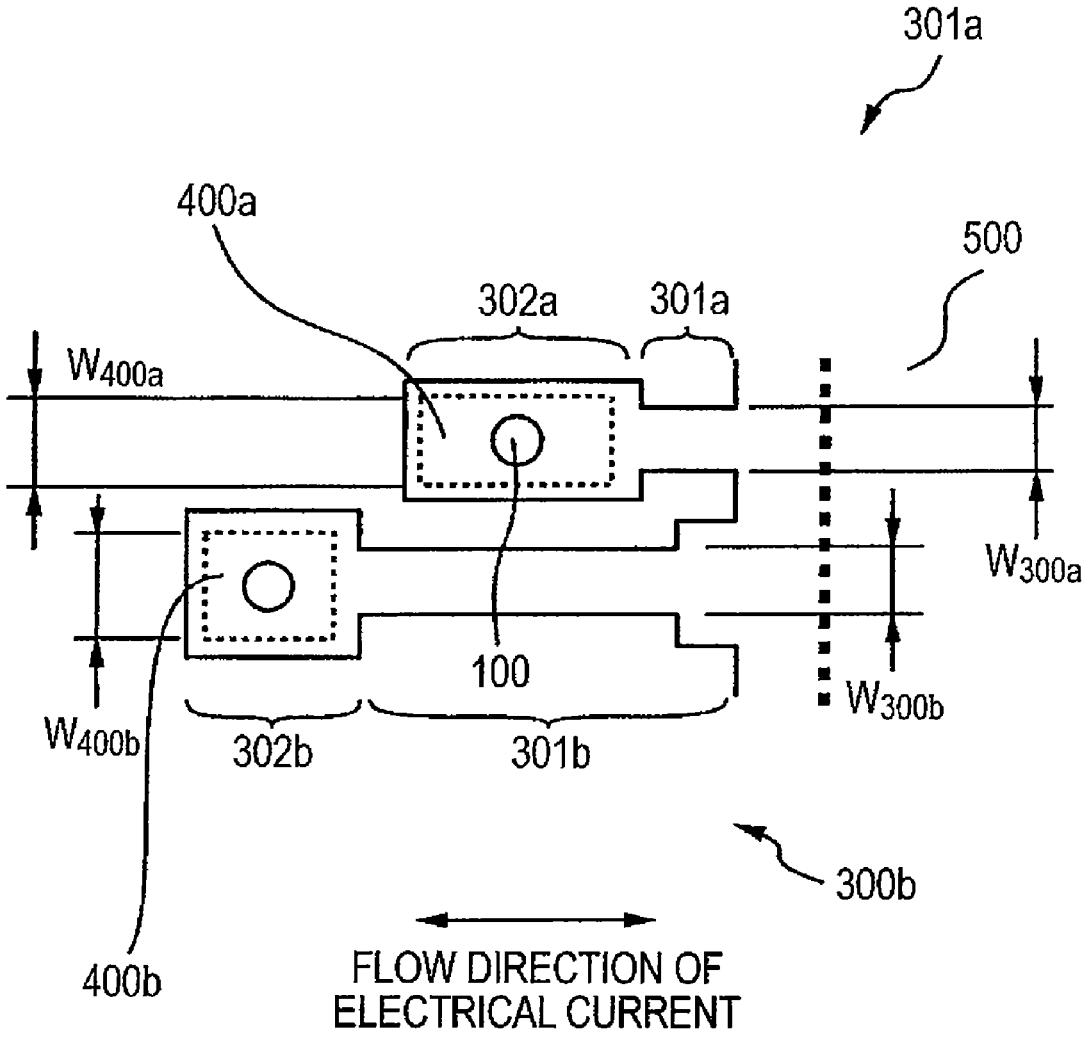
FIG. 5 is an exploded perspective plan view of two types of ink channels and their periphery included in the recording head shown in FIG. 4.

Next, the structure of the recording elements 400 and their periphery characterizing the present invention will be described with reference to FIGS. 4 and 5. FIG. 4 is a partial perspective plan view of the outlet surface of the recording head 101, shown in FIG. 3, and illustrates the recording elements 400 and their periphery in the recording head 101. FIG. 5 is an exploded perspective plan view of two types of ink channels and their periphery included in the recording head 101 shown in FIG. 4.

As illustrated in FIG. 5, the above-described outlet groups 900 include an outlet group 900*a* and an outlet group 900*b*, wherein the ink inlet 500 is interposed between the outlet groups 900*a* and 900*b*. The outlet groups 900*a* and 900*b* basically have the same structure but are offset a half pitch (p/2) in the longitudinal direction of the ink inlet 500 (i.e., the vertical direction in the drawing). Below, outlet group 900*a* is described as an example of the outlet groups 900. Hereinafter, 'outlet group 900*a*' may be simply referred to as 'outlet group 900'.

The outlet group 900 includes first outlets 100*a* disposed closer to the ink inlet 500 and second outlets 100*b* disposed further away from the ink inlet 500. Each of the first outlets

100*a* and each of the second outlets 100*b* are provided alternately along the vertical direction in the drawing. In other words, the outlets 100*a* and 100*b* are disposed in a staggered pattern. The first outlets 100*a* and the second outlets 100*b* are disposed at a pitch p with the same intervals in the vertical direction in the drawing. The outlets 100*a* and 100*b* (or collectively referred to as 'outlets 100') are circular and have the same size.

The pitch p is set so that the outlet density of the outlet group 900 is 1,200 dpi. Since, as described above, the outlet groups 900*a* and 900*b* are offset by a half pitch (p/2), the resolution of the entire recording head 101 is 2,400 dpi. According to this embodiment, the volume of each ink droplet discharged from each of the outlets 100 is 1 pl. The sizes of the components and the ink droplet volume suitable for obtaining the above-mentioned resolution will be described in detail below.

Since the outlets 100*a* and 100*b* are disposed in a staggered pattern, as described above, the ink channels 300 and the recording elements 400 are also disposed in a staggered pattern corresponding to the outlets 100*a* and 100*b*.

More specifically, the ink channels 300, as shown in FIG. 4, include first ink channels 300*a* having a relatively short channel length and being connected to the corresponding first outlets 100*a* and second ink channels having a relatively long channel length 300*b* and being connected to the corresponding second outlets 100*b*. As shown in FIG. 5, the ink channels 300*a* and 300*b* include pressure chambers 302*a* and 302*b*, respectively, and transporting paths 301*a* and 301*b*, respectively. The pressure chambers 302*a* and 302*b* are provided in areas including the outlets 100. The transporting paths 301*a* and 301*b* are configured to transport ink to the pressure chambers 302*a* and 302*b*, respectively. In FIG. 5, the width of the area upstream of the transporting paths 301*b* is greater than the width of the other areas of the transporting paths 301*b*. However, the structure of the transporting paths 301*b* is not limited.

The pressure chambers 302*a* and 302*b* include first recording elements 400*a* and second recording elements 400*b*, respectively. The shape of the first recording elements 400*a* differs from the shape of the second recording elements 400*b*. To achieve satisfactory discharge from the outlets 100*a* and 100*b*, some space is provided between the outside edge of recording elements 400*a* and 400*b* and the inner walls of the pressure chambers 302*a* and 302*b*. The outlets 100*a* and 100*b* are disposed so that they are positioned substantially in the center of the recording elements 400*a* and 400*b*, respectively.

As described above, the transporting paths 301*a* and 301*b* may have small widths ($W_{300a}$ and $W_{300b}$, respectively) compared to the widths of the pressure chambers 302*a* and 302*b*, respectively, so long as ink is stably supplied to the pressure chambers 302*a* and 302*b*. In this embodiment, since the outlets 100*a* and 100*b* are disposed in a staggered pattern, the pressure chambers 302*a* and the pressure chambers 302*b* do not align in the vertical direction in the drawing. In this way, the outlets 100*a* and 100*b* are disposed in a highly dense manner while maintaining a satisfactory thickness of the walls of the transporting paths 301*a* and 301*b*. In particular, the outlets 100*a* and 100*b* can be disposed in a highly dense manner when the width $W_{300b}$ of the transporting paths 301*b* is substantially the same or smaller than the width $W_{400a}$ of the first recording elements 400*a*.

Figure 6B:
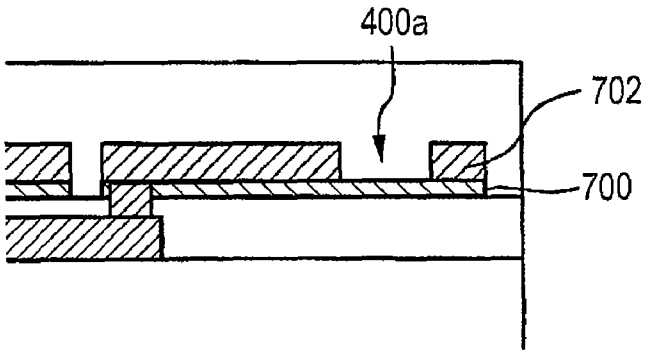
Figure 6C:
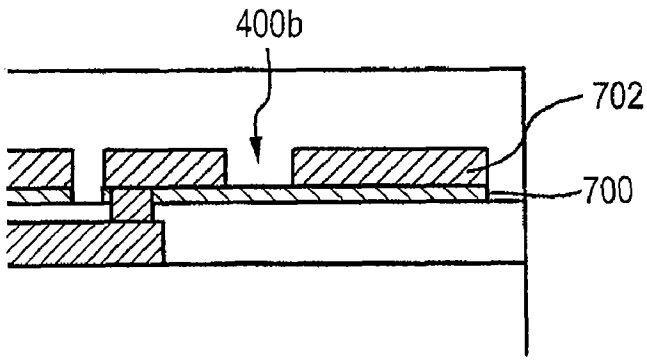
Figure 6A:
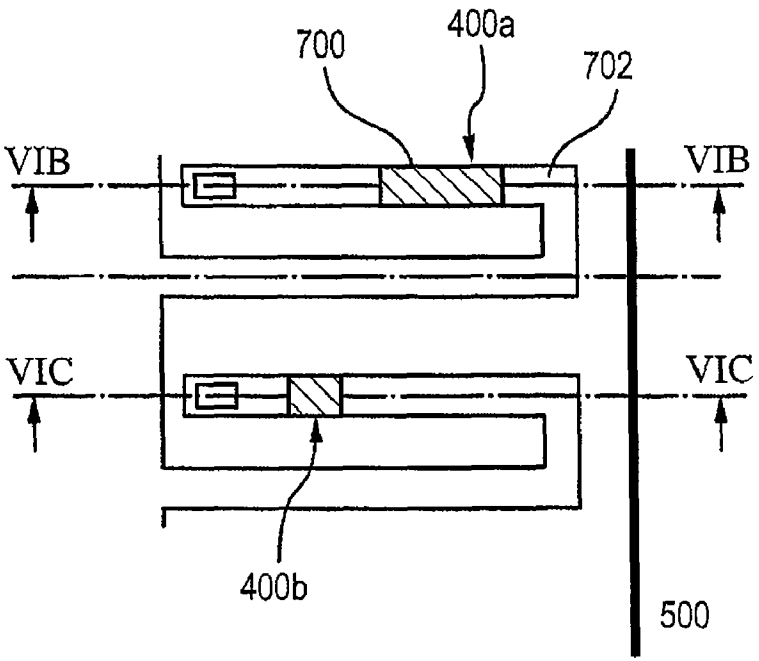

Next, the detailed structure of the recording elements 400*a* and 400*b* including heating resistors is described with reference to FIGS. 6A, 6B and 6C. FIG. 6A is a top view of a wiring pattern configuring the recording elements 400*a* and 400*b*. FIGS. 6B and 6C are cross-sectional views taken along lines VIB-VIB and VIC-VIC, respectively, in FIG. 6A.

As illustrated in FIGS. 6A, 6B and 6C, each of the recording elements 400*a* and 400*b* is formed by removing sections of a wiring layer 702 stacked on a resistive layer 700. When a voltage is applied to the wiring layer 702, the sections removed from the wiring layer 702 on the resistive layer 700 function as resistors and generate heat. Patterning of the recording elements 400*a* and 400*b* having such a structure is easy since the area functioning as resistors can be easily changed by merely changing the pattern of the resistive layer 700 and the wiring layer 702. In this way, the heating value of the recording elements 400*a* and 400*b* can be easily adjusted. As illustrated in FIGS. 6A, 6B and 6C, the first recording elements 400*a* that are formed close to the ink inlet 500 are formed by removing sections from the wiring layer 702 so that rectangular areas of the resistive layer 700 are exposed. The second recording elements 400*b* that are formed further away from the ink inlet 500 are formed by removing sections from the wiring layer 702 so that substantially square areas of the resistive layer 700 are exposed.

When the outlets 100*a* and 100*b* are disposed in a highly dense manner in a staggered pattern, the length of the second ink channels 300*b* becomes relatively longer. As a result, the ink refilling time may be extended and/or the discharge from the second outlets 100*b* may become unstable. Therefore, according to this embodiment, the discharge from the second outlets 100*b* is stabilized by taking two different countermeasures as described below. The first countermeasure taken is to set the area defining each of the second recording elements 400*b* smaller than the area defining each of the first recording elements 400*a*. Another countermeasure taken is to set the aspect ratio of the outer shape of the second recording elements 400*b* smaller than the aspect ratio of the outer shape of the first recording elements 400*a* so that each of the second recording elements 400*b* is substantially of a square shape.

These countermeasures will be described in detail below.

To maintain the discharge balance between the first outlets 100*a* and the second outlets 100*b*, the discharge performance of the nozzles provided further away from the ink inlet 500 (i.e., the nozzles including the second outlets 100*b*) may be improved. Furthermore, the aspect ratio of each of the heating resistors may be set close to 1 (i.e., the shape of the heat resistor may be substantially a square). The discharge is stabilized by reducing the aspect ratio of each of the second recording elements 400*b* because of the following reason. For the recording elements 400*a* and 400*b*, the temperature at their peripheral areas is lower than the temperature at their centers. Thus, the peripheral areas of the recording elements 400*a* and 400*b* do not contribute to the boiling of the ink. Therefore, when the rectangular first recording elements 400*a* are compared with the substantially square second recording elements 400*b*, the area contributing to the boiling of the ink with respect to the entire area of the recording element is relatively larger for the second recording elements 400*b* compared to the first recording elements 400*a*. In other words, the second recording elements 400*b* are capable of effectively transferring discharge energy to the ink.

To obtain an aspect ratio of substantially one by reshaping a rectangular heating resistor, either the width of the heating resistor may be increased or the length of the heating resistor may be reduced. In this embodiment, the nozzle density is predetermined. Therefore, the width of the heating resistors may not be increased due to a lack of space, but the length of the heating resistor may be reduced. As a result, the area of heating resistors disposed further away from the ink inlet 500 is reduced so that the area of the second recording elements 400*b* is smaller than the area of the first recording elements 400*a*.

The recording head 101 according to this embodiment includes the outlets 100 that have the same size and discharge droplets of the same volume. Since the discharge amount of the recording head 101 is small, the absolute refilling frequency is rarely reduced since the refill amount of the nozzles disposed further away from the ink inlet 500 is small.

If the shape of the second recording elements 400*b* is substantially square, the centers of the second recording elements 400*b* can be disposed relatively closer to the ink inlet 500, as shown in FIG. 4, compared to when the shape of the second recording elements 400*b* is rectangular. In this way, refilling becomes easier.

Detailed sizes of the components according to this embodiment are described below.

As an exemplary size of a component described above, the area of the opening of each of the outlets 100 may be 70 $\mu m^2$. Furthermore, the width $W_{400a}$ and the length of the first recording elements 400*a* may be 10 μm and 28 μm, respectively, and the width $W_{400b}$ and the length of the first recording elements 400*b* may be 14 μm and 18 μm, respectively. In other words, the first recording elements 400*a* may have an area of 280 $\mu m^2$, and second recording elements 400*b* may have an area of 252 $\mu m^2$, wherein the area of each of the first recording elements 400*a* is larger than the area of each of the second recording elements 400*b*.

A good discharge balance may be maintained between the first and second recording elements 400*a* and 400*b* of the recording head 101 according to this embodiment having a nozzle density of 1,200 dpi or more and including the outlets 100 of the same shape capable of discharging droplets of the same volume if the following formulas are satisfied (where the aspect ratio is based on the direction of the channel):

$$0.95 > \text{area of second recording element/area of first recording element} > 0.6 \quad (1)$$

and $$\text{aspect ratio of second recording element/aspect ratio of first recording element} < 0.95 \quad (2)$$

As described above, in this embodiment, discharge of the second recording elements 400*b* is carried out more efficiently than discharge of the first recording elements 400*a*. As a result, the discharge characteristics are the same for all of the outlets 100 regardless of the difference in the lengths of the ink channels 300*a* and 300*b*.

In this embodiment, a sufficient amount of energy may be supplied to the recording elements 400*a* and 400*b* to adequately drive the recording elements 400*a* and 400*b*.

More specifically, since the recording elements 400*a* and 400*b* include heating resistors, the heating value of the recording elements 400*a* and 400*b* is determined in accordance with the resistance and the heating value per unit area of the material of the resistive layer 700. The resistance of the recording elements 400*a* and 400*b* is determined in accordance with the shape of the recording elements 400*a* and 400*b*. The resistance of the recording elements 400*a* and 400*b* having the structure shown in FIGS. 6A, 6B and 6C becomes greater as the length of the recording elements 400*a* and 400*b* in the flow direction of the electrical current (i.e., the horizontal direction in FIGS. 6A, 6B and 6C or the width of the ink inlet 500) increases. In other words, resistance becomes greater as the ratio of vertical length to the horizontal length of the recording elements 400*a* and 400*b* becomes greater, where the vertical length is equal to the width of the ink inlet 500. Therefore, when the same driving voltage and the same driving pulse are applied to both the recording elements 400*a* and 400*b*, the amount of energy supplied to recording elements 400*a* and 400*b* may be excessive or insufficient. As a result, the discharge performance of the recording elements 400*a* and 400*b* will vary. In applying the same driving pulse to both recording elements 400*a* and 400*b*, both recording elements 400*a* and 400*b* are driven based on the same driving time.

The recording head 101 according to this embodiment can appropriately drive the recording elements 400*a* and 400*b* by dividing components, such as logic circuits configured to determine the driving pulse of the recording elements or by dividing a driving voltage that supplies electrical power to the driving devices.

Figure 7:
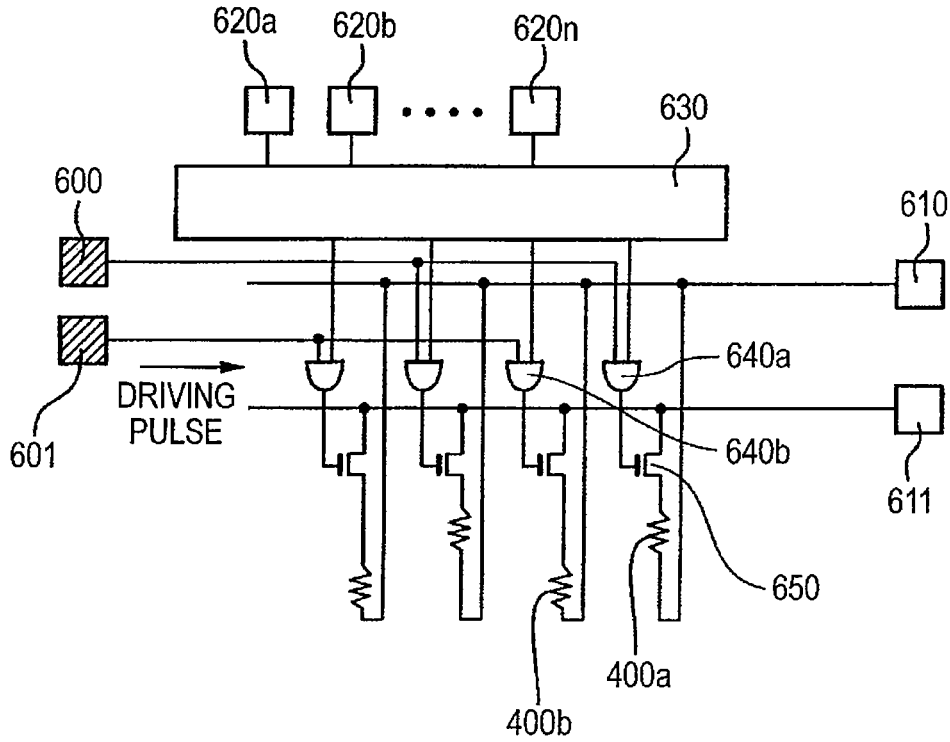
FIG. 7 is a block diagram of the circuitry in which a driving pulse is divided.
Figure 8:
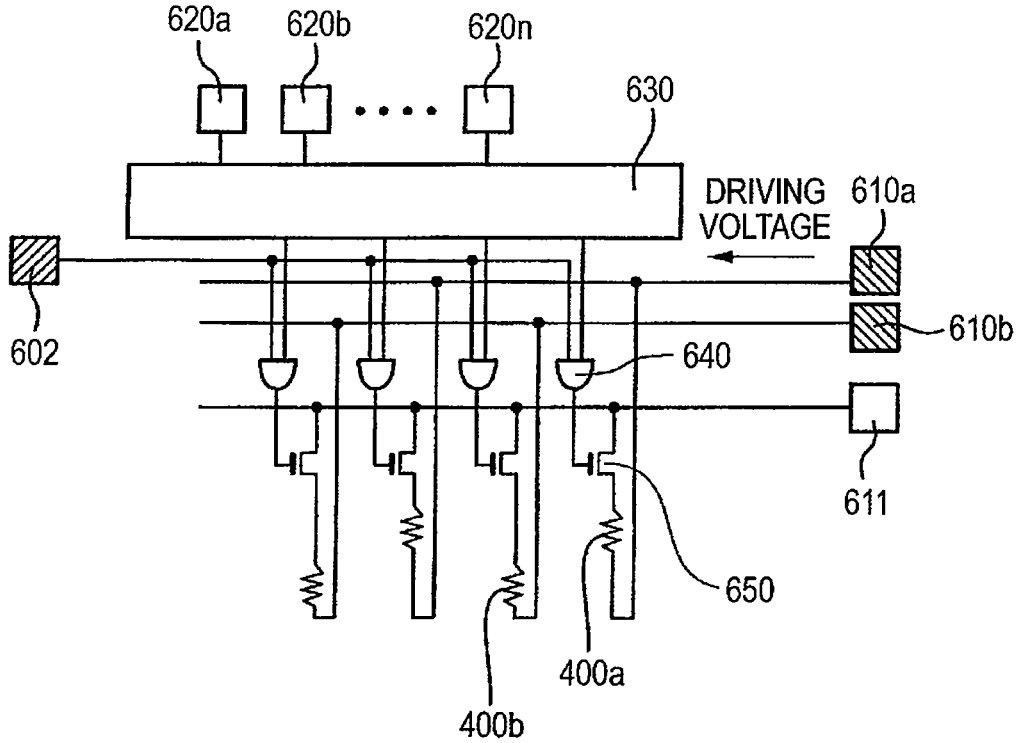
FIG. 8 is a block diagram illustrating the circuitry in which a driving voltage is divided.
Figure 9:
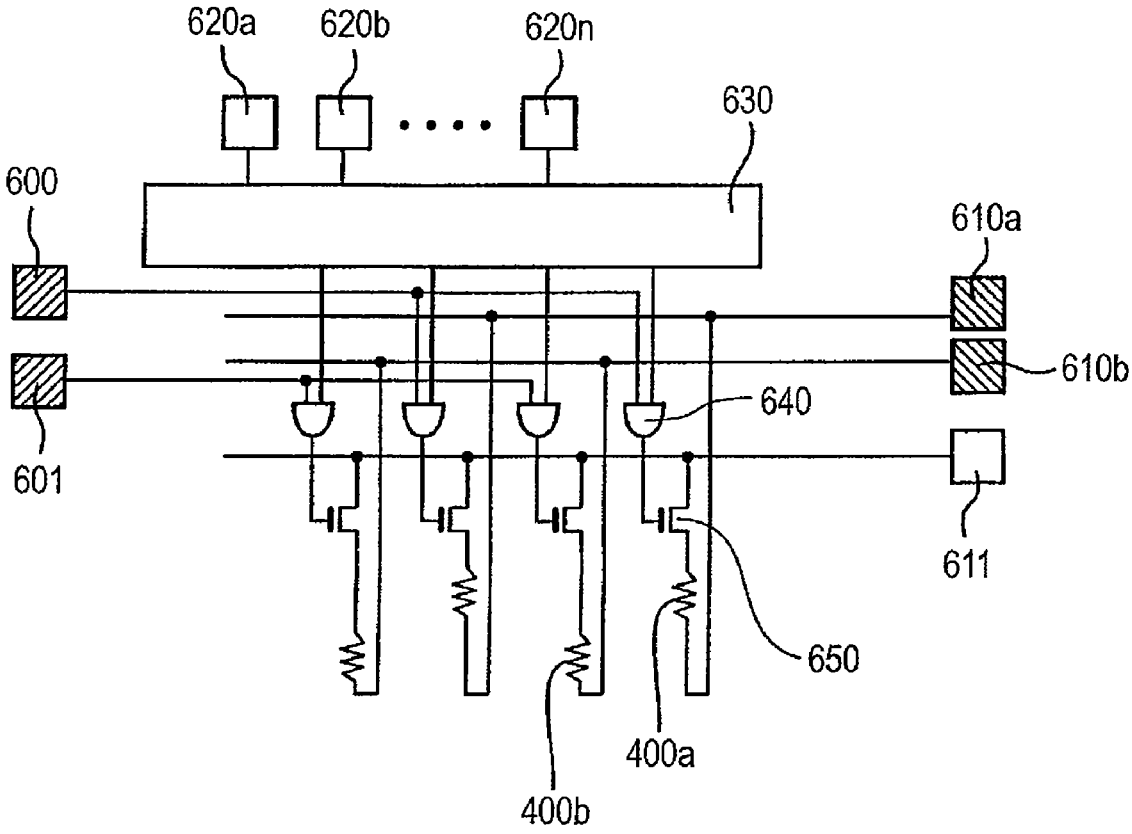
FIG. 9 is a block diagram illustrating the circuitry in which both a driving pulse and a driving voltage are divided.

An exemplary circuitry employed in the recording head 101 according to this embodiment will be described with reference to FIGS. 7, 8, and 9. FIG. 7 is a block diagram illustrating a circuitry in which a driving pulse is divided. FIG. 8 is a block diagram illustrating a circuitry in which a driving voltage is divided. FIG. 9 is a block diagram illustrating a circuitry in which both a driving pulse and a driving voltage are divided.

Structure for Dividing Driving Pulse

The circuitry shown in FIG. 7 includes a processing block 630, a plurality of terminals 620*a* to 620*n*, an electrical power supply terminal 610, a ground (GND) terminal 611, power transistors (drivers) 650, a first driving time determining signal terminal 600, a second driving time determining signal terminal 601, first AND circuits 640*a*, and second AND circuits 640*b*. The processing block 630 is configured to control processing of various data and time-division driving. The plurality of terminals 620*a* to 620*n* are connected to the processing block 630 and send clock (CLK) data, image data, and data related to time-division driving to the processing block 630. The electrical power supply terminal 610 supplies a driving voltage to the recording elements 400*a* and 400*b*. The circuitry includes power transistors (drivers) 650 configured to switch the power distribution to each of the recording elements 400*a* and 400*b*. The first driving time determining signal terminal 600 determines the driving time of the first recording elements 400*a*. The second driving time determining signal terminal 601 determines the driving time of the first recording elements 400*b*. The outputs of the first AND circuits 640*a* and the second AND circuits 640*b* are connected to the power transistor 650.

A signal processed at the processing block 630 is sent to first inputs of the AND circuits 640*a* and 640*b*. A signal from the first driving time determining signal terminal 600 is sent to a second input of the first AND circuits 640*a*, and a signal from the second driving time determining signal terminal 601 is sent to second input of the second AND circuits 640*b*.

In a circuit configured as described above, the driving time determining signal terminal is divided into the driving time determining signal terminals 600 and 601 corresponding to the recording elements 400*a* and 400*b*, respectively. The recording elements 400*a* and 400*b* are driven in accordance with the logical product (AND) of a driving pulse from the driving time determining signal terminal 600 or 601 and recording data from the processing block 630. Accordingly, the recording elements 400*a* and 400*b* are driven based on different driving times (i.e., different driving pulses) sent from the driving time determining signal terminals 600 and 601, respectively. In this way, the recording elements 400*a* and 400*b* can be operated based on appropriate driving times that enable satisfactory discharge.

Structure for Dividing Driving Voltage

In the circuitry shown in FIG. 8, the driving voltage (power supply voltage) supplied to the recording elements 400*a* and 400*b* is divided. In the circuitry shown in FIG. 8, the electrical power supply terminal 610 included in the circuitry shown in FIG. 7 is replaced by two electrical power supply terminals 610*a* and 610*b*. The first electrical power supply terminal 610*a* supplies a driving voltage to the first recording elements 400*a*, and the second electrical power supply terminal 610*b* supplies a driving voltage to the first recording elements 400*b*. In the circuitry shown in FIG. 8, the driving time determining signal terminals 600 and 601 included in the circuitry shown in FIG. 7 are replaced by a common driving time determining signal terminal 602. The other components included in the circuitry shown in FIG. 8 are the same as those included in the circuitry shown in FIG. 7. The components shown in FIG. 8 having the same function as those shown in FIG. 7 are represented by the same reference numerals.

In a circuit configured in this way, separate driving voltages are supplied from the electrical power supply terminal 610*a* and 610*b* to the recording elements 400*a* and 400*b*, respectively. In this way, the recording elements 400*a* and 400*b* can be operated based on appropriate driving times that enable satisfactory discharge.

Structure for Dividing Driving Pulse and Driving Voltage

The circuitries shown in FIGS. 7 and 8 have been described above. These two types of circuitries can be combined as illustrated in FIG. 9. The circuitry shown in FIG. 9 includes two driving time determining signal terminals 600 and 601 and two electrical power supply terminals 610*a* and 610*b*. By using the two driving time determining signal terminals 600 and 601 and two electrical power supply terminals 610*a* and 610*b*, even more precise drive control is possible.

Second Embodiment

Figure 10A:
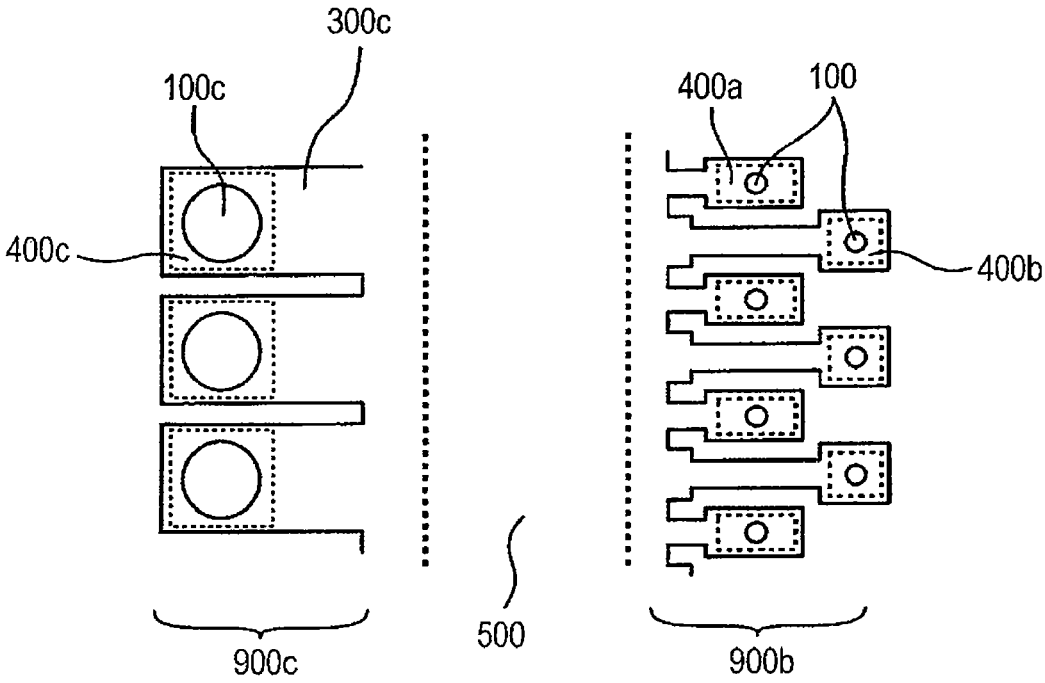
FIGS. 10A and 10B are perspective plan views of a recording head according to a second embodiment.
Figure 10B:
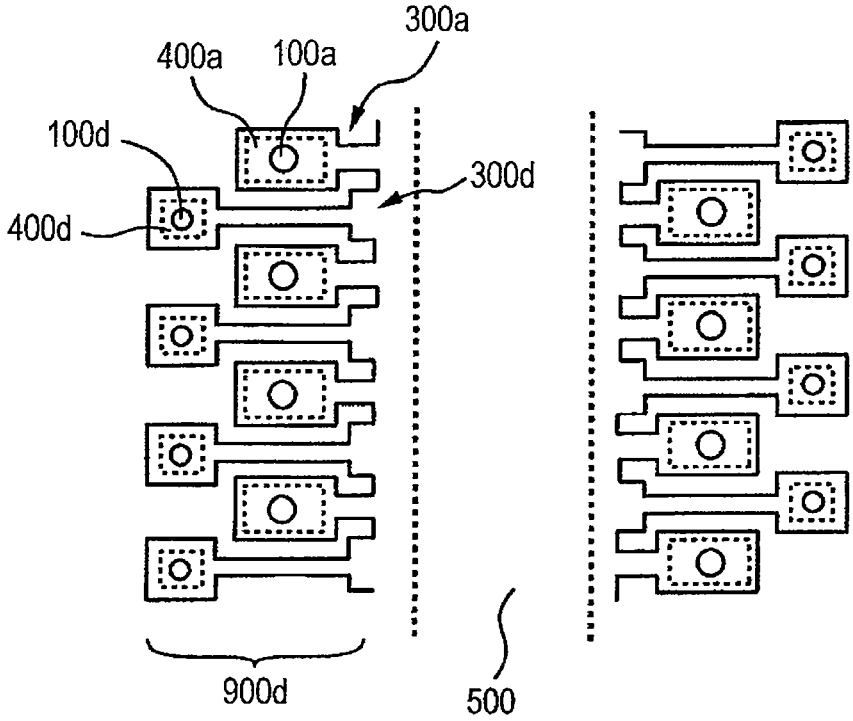

FIGS. 10A and 10B are plan views of outlet surfaces of recording heads according to a second embodiment and illustrate recording elements and their periphery.

The recording head illustrated in FIG. 10A includes an outlet group 900*b* on one side of an ink inlet 500. The outlet group 900*b* has a nozzle density of 1,200 dpi, which is the same nozzle density as the above-described recording head 101 according to the first embodiment. On the other side of the ink inlet 500, an outlet group 900*c* including outlets 100*c*, whose openings are relatively large in area, is provided. The outlets 100*c* are aligned along the longitudinal direction of the ink inlet 500 and receive ink through corresponding ink channels 300*c* having a relatively wide width. The recording elements 400*c* disposed in the ink channels 300*c* are substantially square and their surface area is greater than the recording elements 400*a* and 400*b* according to the first embodiment.

According to the recording head shown in FIG. 10A, when high resolution is required, the outlet group 900*b* can be mainly used, whereas, when high-speed recording is required at a lower resolution, the outlet group 900*c* can be mainly used. In this way, the recording head can be used for both high-quality recording and high-speed recording.

The recording head illustrated in FIG. 10B is the same as the recording head 101 except that third outlets 100*d*, third recording elements 400*d*, and third ink channels 300*d* are provided instead of the second outlets 100*b*, the second recording elements 400*b*, and the second ink channels 300*b*, respectively.

The third outlets 100*d* are smaller than the second outlets 100*b*, and the third recording elements 400*d* are smaller than the second recording elements 400*b*. The shape of the third outlets 100*d* is circular, and the shape of the third recording elements 400*d* is substantially square.

When a recording head has outlets of different diameters in order to perform gradation recording, the recording elements 400*d* (heating resistors) corresponding to the outlets 100*d* having small diameters (i.e., the small outlets) are smaller than the recording elements 400*a* corresponding to the outlets 100*a* having larger diameters (i.e., the large outlets). For the aspect ratio of the heating resistor disposed in the recording elements 400*d* further away from the ink inlet 500 to be substantially one, the outlet diameter of the outlets 100*d* disposed further away from the ink inlet 500 may be small. The refill amount of the ink channels 300*d* corresponding to the small outlets 100*d* is less than the refill amount of the ink channels 300*a* corresponding to the large outlets 10*a* so long as the discharge frequencies are the same for all nozzles. Accordingly, by having the small outlets 400*d* disposed further away from the ink inlet 500, the refill frequency of the entire recording head can be improved.

According to the recording head shown in FIG. 10B, although the discharge amount from the third outlets 100*d* is less than the discharge amount from the first outlets 10*a* according to the first embodiment, since the recording elements 400*d* are substantially square, the discharge from the third outlets 100*d* is stabilized in a similar manner as the above-described recording head 101.

As shown in FIG. 10B, details of the discharge amount from nozzles with different diameters disposed alternately on the recording head according to this embodiment will be described.

To perform gradation recording, the contrast between the image recorded by the large outlets 100*a* discharging a large discharge amount and the small outlets 100*d* discharging a small discharge amount may be twofold. If the pitch is set so that the nozzle density is 1,200 dpi, the distance between adjacent nozzles is 21 μm. Within this distance of 21 μm, an ink channel 300*d* corresponding to the outlet 100*d* disposed further away from the ink inlet 500, the recording element 400*a* disposed closer to the ink inlet 500, and walls separating the ink channel 300*d* and the recording element 400*a* are provided.

The discharge amount also depends on the area of the heating resistor. However, since the width of the heating resistor is limited because of the above-described restrictions, the maximum discharge amount of the large outlets 100*a* disposed closer to the ink inlet 500 is about 2 pl. The maximum discharge amount of the small outlets 100*d* disposed further away from the ink inlet 500 is about 1 pl and the preferable amount of the small outlets 100*d* is about 0.6 pl because of the width of the ink channel 300*d* to the small outlet 100*d*. If the discharge amount of the large outlets 100*a* disposed closer to the ink inlet 500 is set to about 1 pl, the discharge amount of the small outlets 100*d* disposed further away from the ink inlet 500 may be less than about 0.6 pl. However, if the discharge amount is significantly small, the accuracy of the droplets landing at target areas is reduced. Therefore, a discharge amount of about 0.6 pl is appropriate. Accordingly, in this embodiment, if the discharge amount of the small outlets 100*d* disposed further away from the ink inlet 500 is set between 0.4 to 1.0 pl, allowing for a margin of error, the contrast between the image recorded by the large outlets 100*a* and the small outlets 100*d* is maintained and the discharge characteristics for each nozzle are stabilized regardless of the length of the ink channels.

A recording head according to an embodiment, as described above, may be mounted on a typical printing apparatus for inkjet recording. Furthermore, the recording head may be mounted on a copy machine, a facsimile machine including a communication system, a word processor including a printing unit, or an industrial recording apparatus combined with various processors. The above-mentioned typical printing apparatus may include, for example, a conveying unit for conveying a recording medium, a head-holding unit for holding a recording head so that outlets oppose the recording medium and for reciprocatingly scanning the recording medium in the width direction (i.e., the direction orthogonal to the conveying direction), and a controlling unit for driving the conveying unit and the head-holding unit.

The recording head according to this embodiment is not limited to a recording head configured to discharge ink for recording and may include a liquid discharge head configured to discharge liquid using heating resistors included in recording elements.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-326781 filed Nov. 10, 2004, which is hereby incorporated by reference herein.

The invention claimed is:

1. A liquid discharge head comprising:

a plurality of outlets for discharging liquid;

a plurality of liquid channels, each liquid channel communicating with a corresponding outlet;

an inlet for supplying liquid to the liquid channels, the inlet being provided on a substrate; and a plurality of recording elements disposed in the corresponding liquid channels opposite to the plurality of outlets, each recording element including a heating resistor provided on the substrate, wherein the outlets include first outlets disposed relatively closer to the inlet and second outlets disposed relatively further from the inlet and are arranged in a staggered pattern in which the first outlets and the second outlets are disposed alternately on at least one side of the inlet, the recording elements include first recording elements corresponding to the first outlets and second recording elements corresponding to the second outlets, and an aspect ratio of the second recording elements is closer to 1 (one) than the aspect ratio of the first recording elements.

2. The liquid discharge head according to claim 1, wherein each droplet discharged from the first outlets and each droplet discharged from the second outlets have substantially the same volume, and the value obtained by dividing the area of one of the second recording elements by the area of one of the first recording elements is smaller than 0.95 and greater than 0.60 and the value obtained by dividing the aspect ratio one of the second recording elements by the aspect ratio of one of the first recording elements is smaller than 0.95.

3. The liquid discharge head according to claim 1, wherein the volume of each droplet discharged from the second outlets is smaller than the volume of each droplet discharged from the first outlets.

4. The liquid discharge head according to claim 3, wherein the volume of each droplet discharged from the second outlets is 0.4 to 1.0 picoliters.

5. The liquid discharge head according to claim 1, wherein the liquid channels include first liquid channels where the first recording elements are disposed and second liquid channels where the second recording elements are disposed, and the width of sections of the second channels interposed between adjacent first recording elements is substantially the same as the width of the first recording elements or narrower than the width of the first recording elements.

6. The liquid discharge head according to claim 1, further comprising:

a first outlet group including the first outlets; and a second outlet group including the second outlets, wherein the first and second outlet groups are disposed on both sides of the inlet, and the first outlet group and the second outlet group are offset by one-half pitch with respect to each other.

7. The liquid discharge head according to claim 1, further comprising:

a power supply unit configured to supply driving voltages to the recording elements;

drivers capable of switching condition of power distribution to the recording elements, the drivers being disposed on the recording elements; and logic circuits configured to selectively drive the drivers, wherein the logic circuits include first and second driving time determining signal supplying units configured to output a signal corresponding to the driving time of the recording elements to the drivers, the first driving time determining signal supplying unit being provided for the first recording elements and the second driving time determining signal supplying unit being provided for the second recording elements.

8. The liquid discharge head according to claim 1, further comprising:

first and second power supply units configured to supply driving voltages to the recording elements;

drivers capable of switching condition of power distribution to the recording elements, the drivers being disposed on the recording elements; and logic circuits configured to selectively drive the drivers, wherein the first power supply unit is provided for the first recording elements and the second power supply unit is provided for the second recording elements.

* * * * *